US011555501B2

(12) United States Patent
Yao

(10) Patent No.: US 11,555,501 B2
(45) Date of Patent: Jan. 17, 2023

(54) CEILING FAN STRUCTURE

(71) Applicant: Chao Chin Yao, Taichung (TW)

(72) Inventor: Chao Chin Yao, Taichung (TW)

( * ) Notice: Subject to any disclaimer, the term of this patent is extended or adjusted under 35 U.S.C. 154(b) by 148 days.

(21) Appl. No.: 17/091,551

(22) Filed: Nov. 6, 2020

(65) Prior Publication Data

US 2022/0145895 A1 May 12, 2022

(51) Int. Cl.
*F04D 25/08* (2006.01)
*F04D 29/64* (2006.01)
*F04D 25/06* (2006.01)

(52) U.S. Cl.
CPC ..... *F04D 25/088* (2013.01); *F04D 25/0693* (2013.01); *F04D 29/646* (2013.01); *F04D 25/0633* (2013.01)

(58) Field of Classification Search
CPC .. F04D 19/005; F04D 25/088; F04D 25/0633; F04D 25/0693; F04D 29/646; F21V 21/03; F21V 33/0096; F24F 2221/14
See application file for complete search history.

(56) References Cited

U.S. PATENT DOCUMENTS 5,421,701 A * 6/1995 Funston ..... F04D 25/022 416/5
5,536,142 A * 7/1996 Hsieh ..... H01H 17/00 416/61
5,586,867 A * 12/1996 Mehlos ..... F04D 29/601 416/170 R
5,636,758 A * 6/1997 Su ..... G01V 8/10 220/3.94
6,211,632 B1 * 4/2001 Liao ..... F04D 25/088 318/16
8,418,981 B1 * 4/2013 Lowe ..... F04D 29/601 248/342
9,453,517 B1 * 9/2016 Burns ..... F04D 29/601
2004/0191087 A1 * 9/2004 Liu ..... F04D 25/088 417/326
2010/0226784 A1 * 9/2010 Yao ..... F04D 25/088 416/244 R

* cited by examiner

*Primary Examiner* — Devon C Kramer
*Assistant Examiner* — Joseph S. Herrmann
(74) *Attorney, Agent, or Firm* — Bradley J. Thorson; DeWitt LLP

(57) ABSTRACT

A ceiling fan structure includes a mounting bracket, a hanging plate, a coupling, and a motor. The mounting bracket is fixed to a ceiling. The hanging plate has a top fixed to the mounting bracket. The top is formed with a recessed accommodating groove for accommodating a first electronic component. The coupling is connected to a bottom of the accommodating groove and extends downward. The coupling is connected with a support plate extending horizontally. The support plate is configured to support a second electronic component. The internal space of the ceiling fan structure is properly planned so that the components of the ceiling fan structure can be reasonably configured, so as to improve the efficiency of assembly.

5 Claims, 4 Drawing Sheets

CEILING FAN STRUCTURE

FIELD OF THE INVENTION

The present invention relates to a fan, and more particularly to a ceiling fan structure.

BACKGROUND OF THE INVENTION

As shown in FIG. 4, a conventional ceiling fan structure includes a mounting bracket 81 fixed to a ceiling. A rod 82 is coupled under the mounting bracket 81 for hanging a motor and fan blades. The rod 82 is further fixed to a support plate 83. The support plate 83 is configured to support various electronic components used for controlling the motor, such as a forward/reverse rotation controller 91, a receiver 92, a capacitor 93, a circuit board, and so on. However, the above-mentioned various electronic components need to be connected to each other by wires. Due to the large number of components, the wiring work is very complicated and error-prone. In addition, since the above-mentioned various electronic components are arranged on the support plate, the space is not enough to cause the components and their wires to crowd each other, which has the disadvantage of affecting heat dissipation.

SUMMARY OF THE INVENTION

The primary object of the present invention is to provide a ceiling fan structure. The internal space of the ceiling fan structure is properly planned so that the components of the ceiling fan structure can be reasonably configured, so as to improve the efficiency of assembly.

In order to achieve the foregoing object, the present invention provides a ceiling fan structure, comprising:

a mounting bracket fixed to a ceiling;

a hanging plate, having a top fixed to the mounting bracket, the top being formed with a recessed accommodating groove for accommodating a first electronic component;

a coupling, connected to a bottom of the accommodating groove and extending downward, the coupling being connected with a support plate extending horizontally, the support plate being configured to support a second electronic component;

a motor, connected to the coupling.

Preferably, the first electronic component is a receiver, the second electronic component is a motor forward/reverse rotation module, and the motor forward/reverse rotation module is provided with an integrated output flat cable connector.

Preferably, the accommodating groove is surrounded by four connected side walls connected to the top and a bottom wall connected to the four side walls, and the first electronic component is a receiver.

Preferably, one of the side walls is formed with a wire hole through which a wire passes.

DETAILED DESCRIPTION OF THE PREFERRED EMBODIMENTS

Embodiments of the present invention will now be described, by way of example only, with reference to the accompanying drawings.

Figure 1:
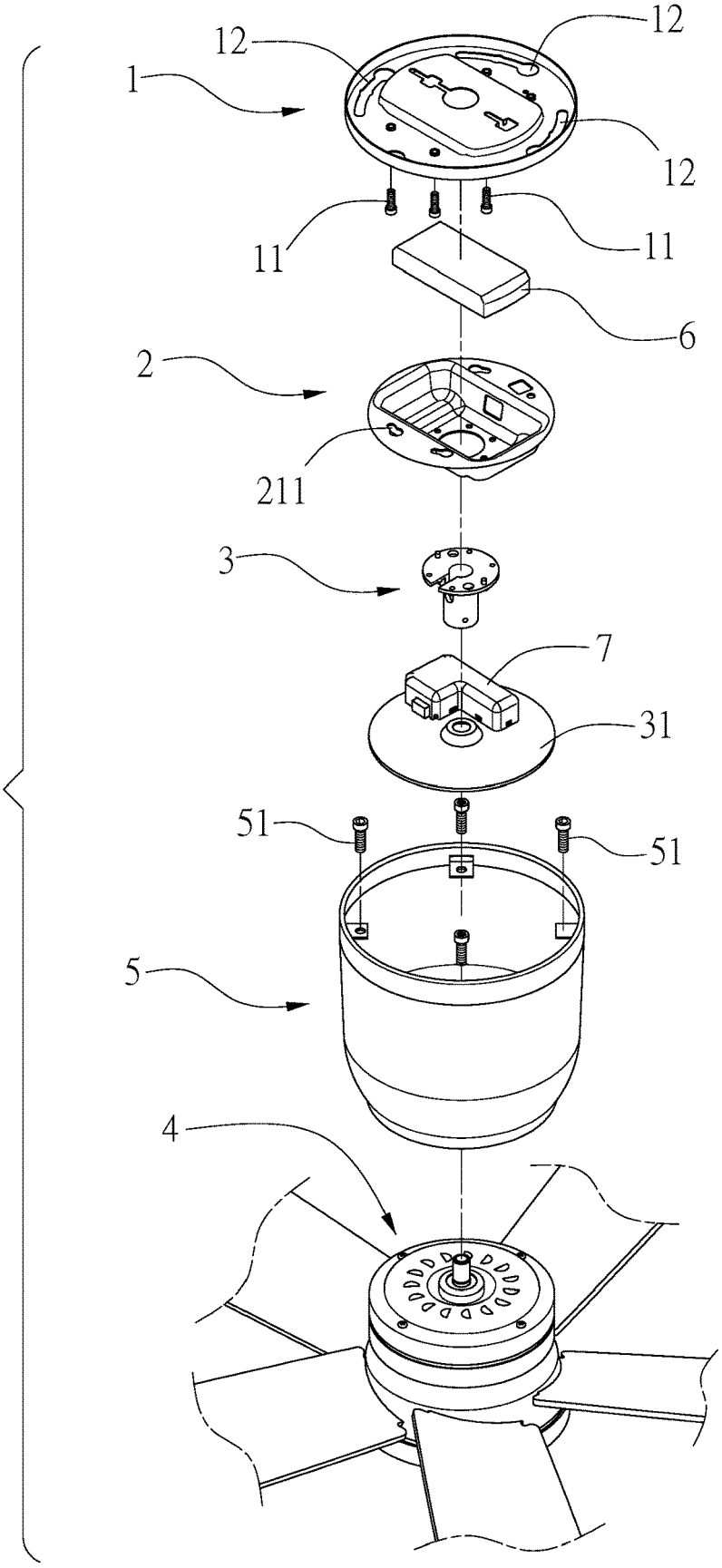
FIG. 1 and FIG. 2 are exploded schematic views of the present invention.
Figure 2:
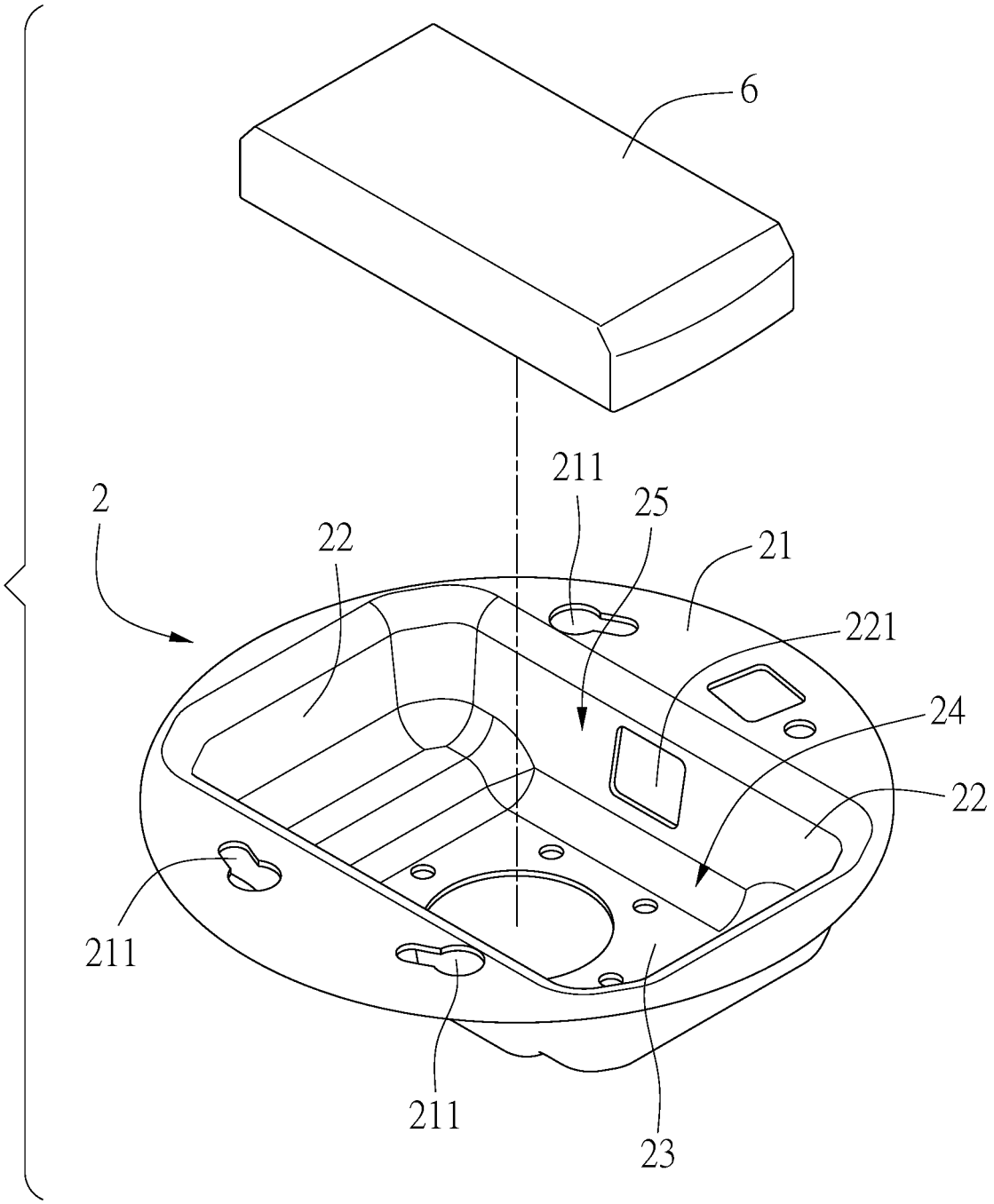
Figure 3:
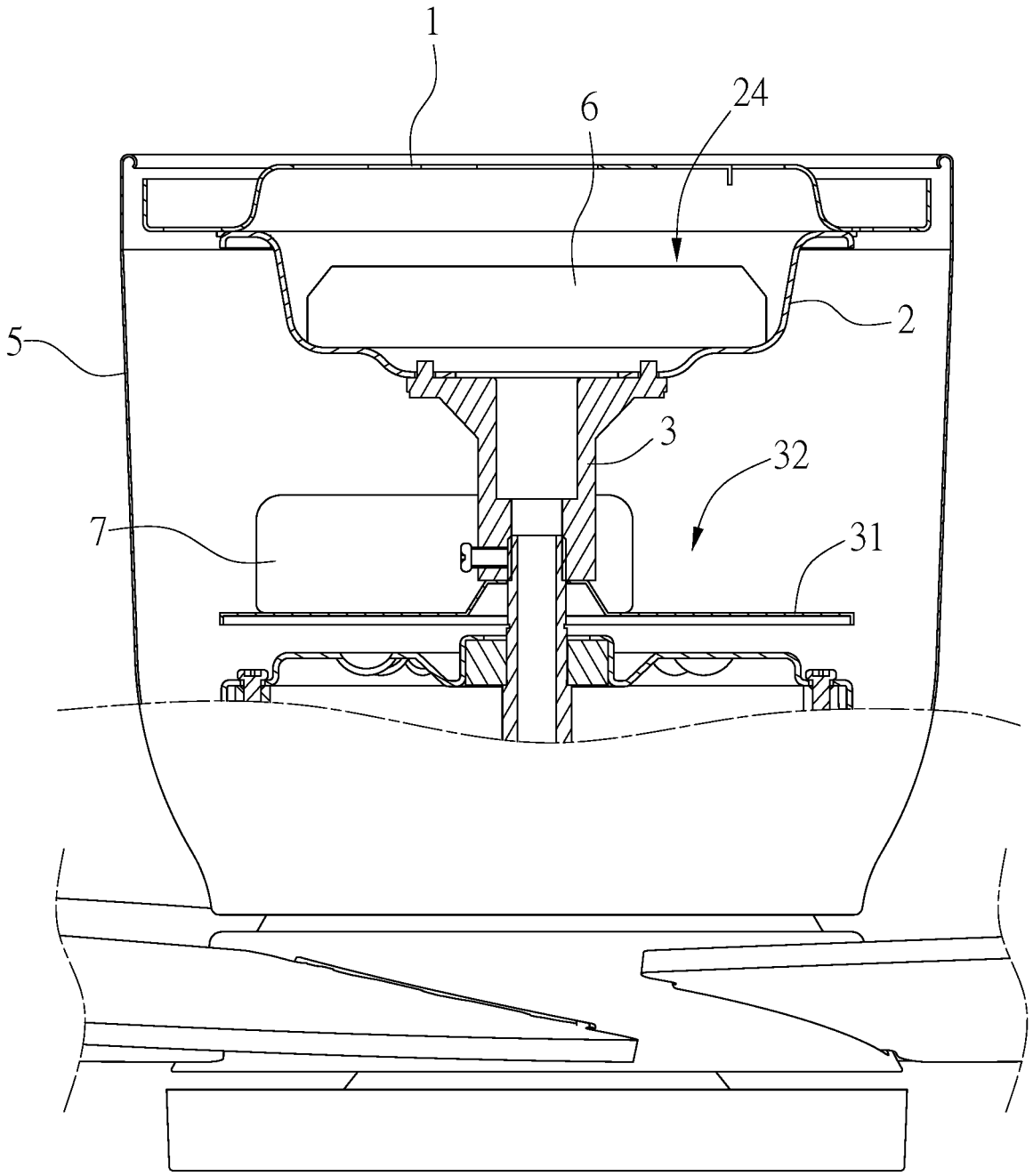
FIG. 3 is a cross-sectional schematic view of the present invention.
Figure 4:
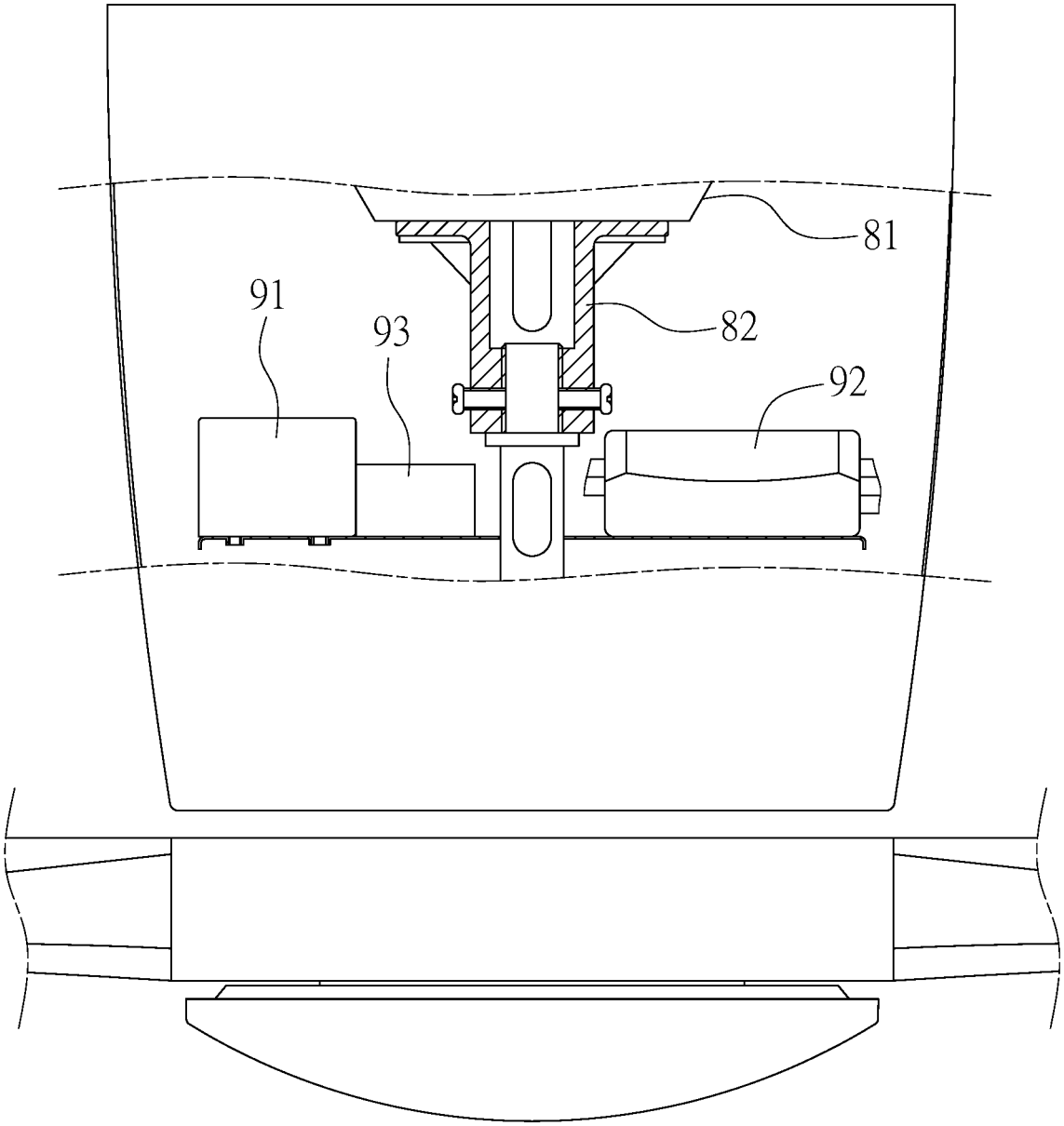
FIG. 4 is a cross-sectional schematic view of a conventional ceiling fan structure.

Referring to FIG. 1 through FIG. 3, the present invention discloses a ceiling fan structure, comprising a mounting bracket 1, a hanging plate 2, a coupling 3, a motor 4, and a housing 5. The mounting bracket 1 is fixed to a ceiling. The hanging plate 2 has a top 21. The top 21 is formed with a plurality of gourd-shaped holes 211. The mounting bracket 1 is provided with a plurality of screws 11. The hanging plate 2 is rotatably coupled to the mounting bracket 1 through the cooperation of the gourd-shaped holes 211 and the screws 11.

The middle portion of the top 21 of the hanging plate 2 is recessed downward to form four connected side walls 22 connected to the top 21 and a bottom wall 23 connected to the four side walls 22. A rectangular accommodating groove 24 is defined between the four side walls 22 and the bottom wall 23 to provide a first accommodating space 25 for accommodating a receiver 6. Furthermore, one of the side walls 22 is formed with a wire hole 221 for the wire of the receiver 6 to extend out of the accommodating groove 24.

The top end of the coupling 3 is locked to the bottom wall 23, and the bottom end of the coupling 3 extends downward and is connected to the motor 4, thereby hanging and positioning the motor 4 on the ceiling. The coupling 3 is connected with a support plate 31 extending horizontally. A second accommodating space 32 is defined above the support plate 31 to support a motor forward/reverse rotation module 7. The motor forward/reverse rotation module 7 is a component that integrates a controller used for controlling the forward/reverse rotation of the motor 4 and a capacitor used for controlling the speed of the motor 4, and that integrates its wire connectors into an output flat cable connector (not shown in the figure). Accordingly, only the output flat cable connector needs to be wired in the assembly process, instead of wiring each electronic component one by one, so as to simplify the assembly and save time.

The mounting bracket 1 is formed with a plurality of gourd-shaped holes 12. The housing 5 is provided with a plurality of screws 51. The housing 5 is rotatably coupled to the mounting bracket 1 through the cooperation of the gourd-shaped holes 12 and the screws 51, and covers various components of the ceiling fan, including the hanging plate 2, the coupling 3 and the motor 4.

With the above structure, the present invention properly plans the space inside the ceiling fan for the hanging plate 2 to form the accommodating groove 24, and the receiver 6 is arranged in the accommodating groove 24, without installing on the support plate 31. In addition, the present invention may be a ceiling fan without a receiver in the original specifications. The accommodating groove of the hanging plate is provided for the user to install the receiver thereafter to facilitate the assembly. Accordingly, since the receiver 6 and the motor forward/reverse rotation module 7 are respectively located in the accommodating groove 24 and on the support plate 31, they will not crowd each other. Thus, other components can have a reasonable configuration, so that the internal components of the ceiling fan are kept at an appropriate distance to facilitate ventilation and heat dissipation.

What is claimed is:

1. A ceiling fan structure, comprising:

a mounting bracket fixed to a ceiling;

a hanging plate, having a top fixed to the mounting bracket, the top being formed with a recessed accommodating groove accommodating a first electronic component;

a coupling, connected to a bottom of the recessed accommodating groove and extending downward, the coupling being connected with a support plate extending horizontally, the support plate supporting a second electronic component;

a motor, connected to a bottom end of the coupling and disposed below the support plate; and a housing, connected to the mounting bracket and covering the hanging plate, the coupling and the motor.

2. The ceiling fan structure as claimed in claim 1, wherein the first electronic component is a receiver, and the second electronic component is a motor forward/reverse rotation module.

3. The ceiling fan structure as claimed in claim 2, wherein the motor forward/reverse rotation module is provided with an integrated output flat cable connector.

4. The ceiling fan structure as claimed in claim 1, wherein the recessed accommodating groove is surrounded by four connected side walls connected to the top and a bottom wall connected to the four side walls, and the first electronic component is a receiver.

5. The ceiling fan structure as claimed in claim 4, wherein one of the side walls is formed with a wire hole through which a wire passes.

* * * * *